US007347045B2

(12) United States Patent
Bozmoski et al.

(10) Patent No.: US 7,347,045 B2
(45) Date of Patent: Mar. 25, 2008

(54) MOTORCYCLE DYNAMIC EXHAUST SYSTEM

(75) Inventors: Alexander J. Bozmoski, Brookfield, WI (US); Timothy R. Osterberg, Hubertus, WI (US); Michael P. Christopherson, Waukesha, WI (US); Anthony L. Coffey, Cedarburg, WI (US); William P. Pari, Waukesha, WI (US); Michael R. Richter, East Troy, WI (US); Stacy L. Smith, Oconomowoc, WI (US); Richard G. Pierson, New Berlin, WI (US); Michael A. Selwa, Oconomowoc, WI (US)

(73) Assignee: Harley-Davidson Motor Company Group, Inc., Milwaukee, WI (US)

( * ) Notice: Subject to any disclaimer, the term of this patent is extended or adjusted under 35 U.S.C. 154(b) by 368 days.

(21) Appl. No.: 10/881,189

(22) Filed: Jun. 30, 2004

(65) Prior Publication Data

US 2006/0000205 A1 Jan. 5, 2006

(51) Int. Cl.
*F02B 27/02* (2006.01)

(52) U.S. Cl. ..... 60/312; 60/287; 60/324

(58) Field of Classification Search ..... 60/287, 60/288, 312, 324
See application file for complete search history.

(56) References Cited

U.S. PATENT DOCUMENTS

| | | | |
|---|---|---|---|
| 951,770 | A | 3/1910 | Miller |
| 981,584 | A | 1/1911 | Miller |
| 1,591,088 | A | 7/1926 | Holmes |
| 2,382,159 | A | 8/1945 | Klemm |
| 2,808,896 | A | 10/1957 | Wilman |
| 3,042,138 | A | 7/1962 | Reinert |
| 3,141,519 | A | 7/1964 | Bottum |
| 3,523,418 | A | 8/1970 | Marsee |
| 3,703,937 | A | 11/1972 | Tenney |
| 3,751,921 | A | 8/1973 | Blomberg et al. |
| 4,408,576 | A | 10/1983 | Sakaoka |
| 4,422,415 | A | 12/1983 | Matsuo et al. |
| 4,423,706 | A | 1/1984 | Onodera |
| 4,483,282 | A | 11/1984 | Sakaoka |
| 4,522,029 | A | 6/1985 | Tomita et al. |
| 4,554,785 | A | 11/1985 | Oike |
| 4,558,566 | A | 12/1985 | Shirakura |
| 4,759,320 | A | 7/1988 | Fujii et al. |
| 4,765,137 | A | 8/1988 | Sakurai et al. |

(Continued)

FOREIGN PATENT DOCUMENTS

| | | |
|---|---|---|
| DE | 2514689 | 9/1976 |

(Continued)

*Primary Examiner*—Thomas Denion
*Assistant Examiner*—Diem Tran
(74) *Attorney, Agent, or Firm*—Michael Best & Friedrich LLP

(57) ABSTRACT

The present invention provides a method of operating a dynamic exhaust system of a motorcycle engine. The method includes providing a valve in the exhaust system that is movable to direct exhaust gases between a first flow path through the exhaust system and a second flow path through the exhaust system. The method includes actuating the valve at a first speed to redirect exhaust gases from the first flow path to the second flow path and actuating the valve at a second speed greater than the first speed to redirect exhaust gases from the second flow path to the first flow path.

10 Claims, 7 Drawing Sheets

U.S. PATENT DOCUMENTS 4,785,626 A 11/1988 Shiraishi
4,795,420 A 1/1989 Sakurai et al.
4,821,685 A 4/1989 Matsushima et al.
4,860,538 A 8/1989 Takeuchi
4,890,586 A 1/1990 Fujii et al.
4,896,504 A 1/1990 Matsui
4,901,528 A 2/1990 Saigo et al.
4,903,483 A 2/1990 Atsuumi et al.
4,913,260 A 4/1990 Fallon
4,916,897 A 4/1990 Hayashi et al.
4,926,636 A * 5/1990 Tadokoro et al. ..... 60/312
4,939,898 A 7/1990 Ichimura et al.
4,941,319 A 7/1990 Yamamoto et al.
4,995,233 A * 2/1991 Lulloff ..... 60/324
4,999,999 A 3/1991 Takahashi et al.
5,014,817 A * 5/1991 Takato et al. ..... 181/254
5,092,284 A 3/1992 Yamada
5,096,010 A 3/1992 Ojala et al.
5,134,850 A * 8/1992 Saito et al. ..... 60/313
5,176,114 A 1/1993 Brackett
5,261,231 A 11/1993 Huh
5,311,848 A 5/1994 Isaka et al.
5,333,576 A 8/1994 Verkleeren
5,351,481 A * 10/1994 Flugger ..... 60/273
5,388,408 A * 2/1995 Lawrence ..... 60/324
5,438,964 A 8/1995 Breidenbach
5,571,239 A 11/1996 Kameda et al.
5,590,628 A 1/1997 Patyi et al.
5,628,287 A 5/1997 Brackett et al.
5,632,239 A 5/1997 Patyi et al.
5,692,374 A 12/1997 Seki et al.
5,758,614 A 6/1998 Choi
5,860,400 A 1/1999 Suart et al.
5,860,405 A 1/1999 Muramatsu et al.
5,921,081 A 7/1999 Kim
6,047,677 A 4/2000 Kim
6,073,601 A 6/2000 Guichard et al.
6,178,745 B1 * 1/2001 Meusen ..... 60/312
6,220,907 B1 4/2001 Shimizu
6,250,076 B1 6/2001 Kawamata et al.
6,336,321 B1 1/2002 Sagara et al.
6,349,541 B1 2/2002 Gruden et al.
6,378,471 B1 4/2002 Yamada et al.
6,422,201 B1 7/2002 Yamada et al.
6,450,141 B1 9/2002 Sakuma
6,454,047 B1 * 9/2002 Galaitsis ..... 181/254
6,546,722 B2 4/2003 Sagara et al.
6,584,767 B1 * 7/2003 Koenig ..... 60/288
6,598,390 B2 * 7/2003 Chang ..... 60/323
6,633,646 B1 * 10/2003 Hwang ..... 381/71.5
6,662,554 B2 * 12/2003 Sheidler et al. ..... 60/290
6,729,122 B2 * 5/2004 Watanabe et al. ..... 60/278
6,938,729 B2 * 9/2005 Worner et al. ..... 181/254
2005/0067211 A1 3/2005 Inaoka et al.
2005/0081516 A1 4/2005 Inaoka et al.

FOREIGN PATENT DOCUMENTS

FR 764504 5/1934
GB 446914 5/1936
JP 01-208516 * 8/1989
JP 03-003922 * 1/1991
JP 2689720 6/1992

* cited by examiner

MOTORCYCLE DYNAMIC EXHAUST SYSTEM

FIELD OF THE INVENTION

This invention relates generally to motorcycles, and more particularly to dynamic exhaust systems for motorcycles.

BACKGROUND OF THE INVENTION

Various designs of motorcycle dynamic exhaust systems are known in the art. Typically, dynamic exhaust systems are utilized to alter the performance of the motorcycle's engine and/or the noise emissions from the motorcycle's engine. In a conventional dynamic exhaust system for a motorcycle, a valve is positioned in a muffler to define a restrictive flow path through the muffler, which may be utilized when it is desirable to decrease the noise emissions of the engine, and a less restrictive flow path, which may be utilized when it is desirable to increase the performance of the engine. The valve is typically moved to direct exhaust gases from the engine through either of the restrictive or less restrictive flow paths. An actuator that is responsive to engine vacuum is commonly utilized to actuate the valve, such that when engine vacuum is high, the actuator actuates the valve to direct the exhaust gases through the restrictive flow path of the muffler to quiet the engine. Also, when the engine vacuum is low, the actuator actuates the valve to direct the exhaust gases through the less restrictive flow path of the muffler to increase the performance of the engine.

SUMMARY OF THE INVENTION

The present invention provides a method of operating an dynamic exhaust system of a motorcycle engine. The method includes providing a valve in the exhaust system that is movable to direct exhaust gases between a first flow path through the exhaust system and a second flow path through the exhaust system. The method includes actuating the valve at a first speed to redirect exhaust gases from the first flow path to the second flow path and actuating the valve at a second speed greater than the first speed to redirect exhaust gases from the second flow path to the first flow path.

The method includes, in another aspect, actuating the valve in the exhaust system in a crossover region of first and second torque characteristics of the first and second flow paths, respectively.

The present invention provides, in yet another aspect, a motorcycle including a valve and an actuator supported by an airbox. The actuator is operatively coupled to the valve to move the valve between a first position, in which exhaust gases are directed along the first flow path, and a second position, in which exhaust gases are directed along the second flow path.

Other features and aspects of the present invention will become apparent to those skilled in the art upon review of the following detailed description, claims and drawings.

BRIEF DESCRIPTION OF THE DRAWINGS

In the drawings, wherein like reference numerals indicate like parts.

Figure 1:
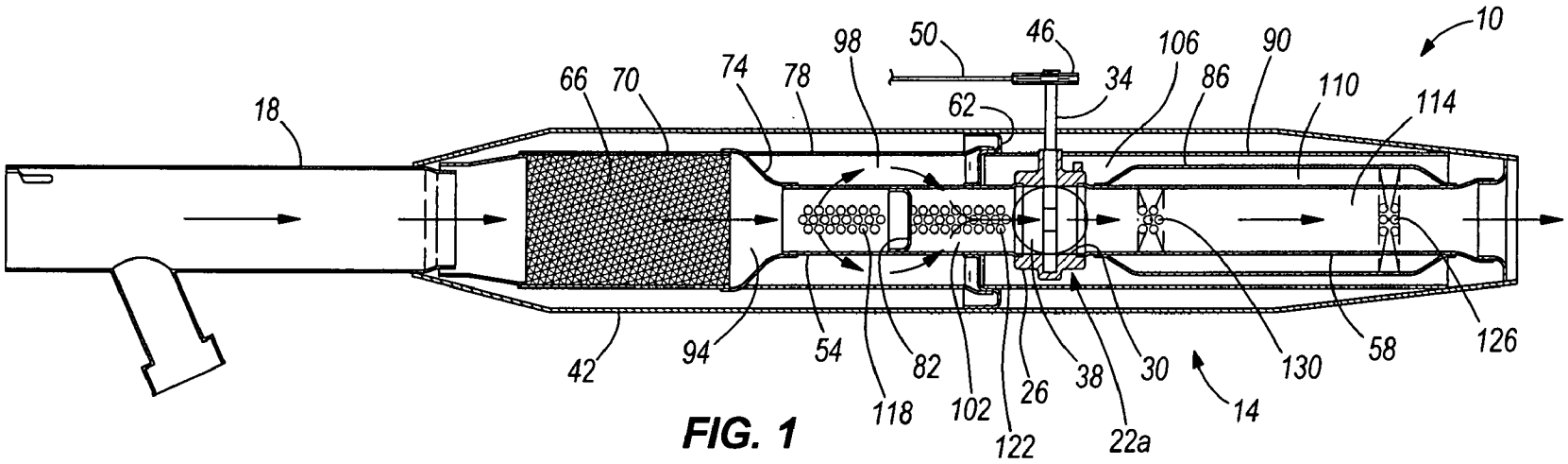
FIG. 1 is a cross-sectional view of a first construction of a dynamic exhaust system embodying the present invention, illustrating exhaust gases flowing through a first flow path of the exhaust system.

Before any features of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including", "having", and "comprising" and variations thereof herein is meant to encompass the items listed thereafter and equivalents thereof as well as additional items. The use of letters to identify elements of a method or process is simply for identification and is not meant to indicate that the elements should be performed in a particular order.

DETAILED DESCRIPTION

Figure 2:
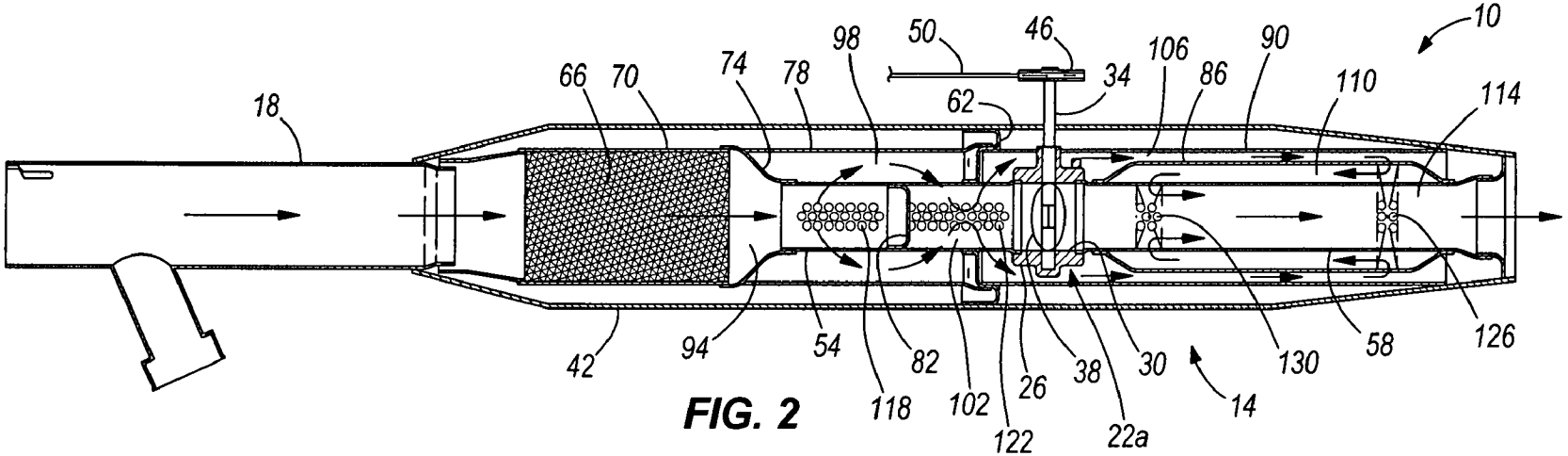
FIG. 2 is a cross-sectional view of the dynamic exhaust system of FIG. 1, illustrating exhaust gases flowing through a second flow path of the exhaust system.

FIGS. 1 and 2 illustrate a first construction of a motorcycle dynamic exhaust system 10 embodying the present invention. The exhaust system 10 includes a muffler 14 coupled to an exhaust pipe 18 in a conventional manner. Although not shown, the exhaust system 10 may incorporate a second exhaust pipe and a second muffler.

The muffler 14 incorporates a valve assembly 22*a* to direct the flow of exhaust gases through the muffler 14. In the illustrated construction, the valve assembly 22*a* includes a valve housing 26 defining a central passageway 30. A shaft 34 is rotatably supported by the valve housing 26, and a butterfly valve 38 is coupled to the shaft 34. The butterfly valve 38 is positioned in the central passageway 30 to selectively restrict the flow of exhaust gases through the passageway 30, as discussed in more detail below. The shaft 34 extends through an outer shell 42 of the muffler 14, and a quadrant or a lever 46 is coupled to the shaft 34 to receive a cable 50 for pivoting or rotating the shaft 34 and the butterfly valve 38.

The muffler 14 also includes an inlet tube 54 coupled to the valve housing 26 at an inlet end of the valve housing 26, and an outlet tube 58 coupled to the valve housing 26 at an outlet end of the valve housing 26. The inlet tube 54 is supported in the outer shell 42 of the muffler 14 by a tube support member 62. The muffler 14 further includes a catalyst 66 located within a catalyst tube 70, which is coupled to the inlet tube 54 via a transition sleeve 74. A first sleeve 78 surrounds the inlet tube 54 and is coupled between the tube support member 62 and the transition sleeve 74. A plug 82 is positioned within the inlet tube 54 such that unobstructed flow of exhaust gases through the entire length of the inlet tube 54 is restricted.

With continued reference to FIGS. 1 and 2, the muffler 14 includes a second sleeve 86 surrounding the outlet tube 58, such that opposite ends of the second sleeve 86 are pinched into contact with the outer surface of the outlet tube 58. The muffler 14 also includes a third sleeve 90 surrounding the second sleeve 86, with one end of the third sleeve 90 being coupled to the tube support member 62 and the opposite end being in abutting contact with the outer shell 42.

As a result of the above-identified internal components of the muffler 14, the muffler 14 generally defines a plurality of chambers through which exhaust gases may flow. More particularly, the space bounded by the catalyst tube 70, the transition sleeve 74, and a portion of the inlet tube 54 upstream of the plug 82 defines a first chamber 94, while the space bounded by the first sleeve 78, the inlet tube 54, the transition sleeve 74, and the tube support member 62 defines a second chamber 98. In addition, the space bounded by a portion of the inlet tube 54 downstream of the plug 82 and the closed butterfly valve 38 defines a third chamber 102, and the space bounded between the second sleeve 86, the third sleeve 90, and the tube support member 62 defines a fourth chamber 106. Further, the space bounded by the second sleeve 86 and the outlet tube 58 defines a fifth chamber 110, while the space bounded by the closed butterfly valve 38 and the outlet tube 58 defines a sixth chamber 114.

With reference to FIG. 1, a first flow path of exhaust gases is shown through the muffler 14 by a sequence of arrows. The butterfly valve 38 is shown pivoted to an open position, in which unobstructed flow of exhaust gases is allowed through the passageway 30 in the valve housing 26. More particularly, exhaust gases exiting the exhaust pipe 18 enter the first chamber 94 of the muffler 14 and encounter the plug 82, which redirects the exhaust gases into the second chamber 98 via a plurality of first apertures 118 formed in the inlet tube 54. The exhaust gases are then directed into the third chamber 102 via a plurality of second apertures 122 formed in the inlet tube 54. From the third chamber 102, the exhaust gases may pass unobstructed through the passageway 30 of the valve housing 26 and enter the sixth chamber 114, thereby bypassing the fourth and fifth chambers 106, 110 of the muffler 14. From the sixth chamber 114, the exhaust gases may exit the muffler 14.

With reference to FIG. 2, a second flow path of exhaust gases is shown through the muffler 14 by a sequence of arrows. The butterfly valve 38 is shown pivoted to a closed position, in which exhaust gases are not allowed to flow through the passageway 30 in the valve housing 26. More particularly, exhaust gases pass through the first, second, and third chambers 94, 98, 102 as described above with reference to FIG. 1. However, since the butterfly valve 38 is closed, exhaust gases in the third chamber 102 are directed into the fourth chamber 106 via the plurality of second apertures 122. From the fourth chamber 106, the exhaust gases are directed into the fifth chamber 110 via a plurality of third apertures 126 formed in the second sleeve 86. Further, the exhaust gases in the fifth chamber 110 are directed into the sixth chamber 114 via a plurality of fourth apertures 130 formed in the outlet tube 58. From the sixth chamber 114, the exhaust gases may exit the muffler 14.

Figure 3:
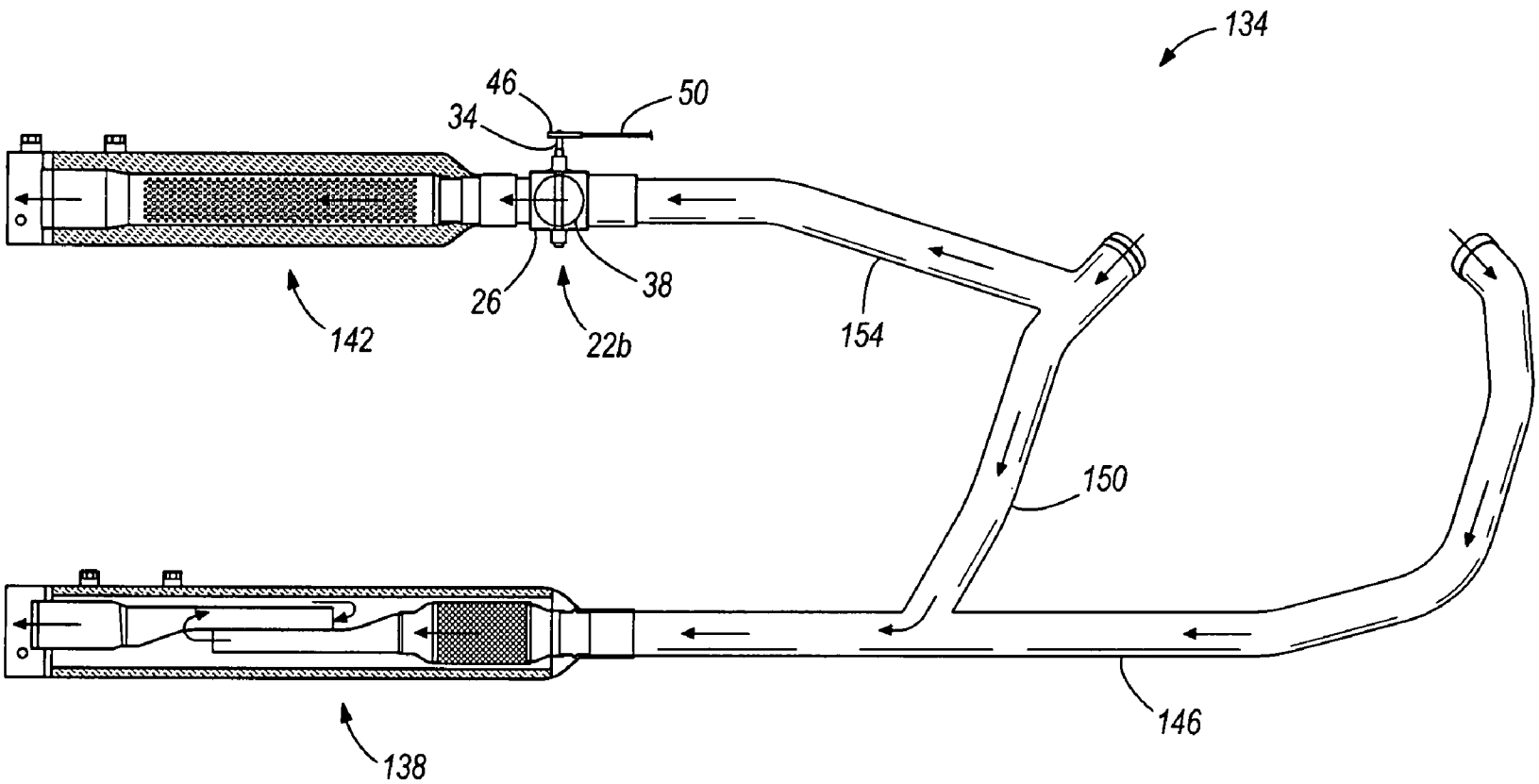
FIG. 3 is a partial cross-sectional view of a second construction of a dynamic exhaust system embodying the present invention, illustrating exhaust gases flowing through a first flow path of the exhaust system.
Figure 4:
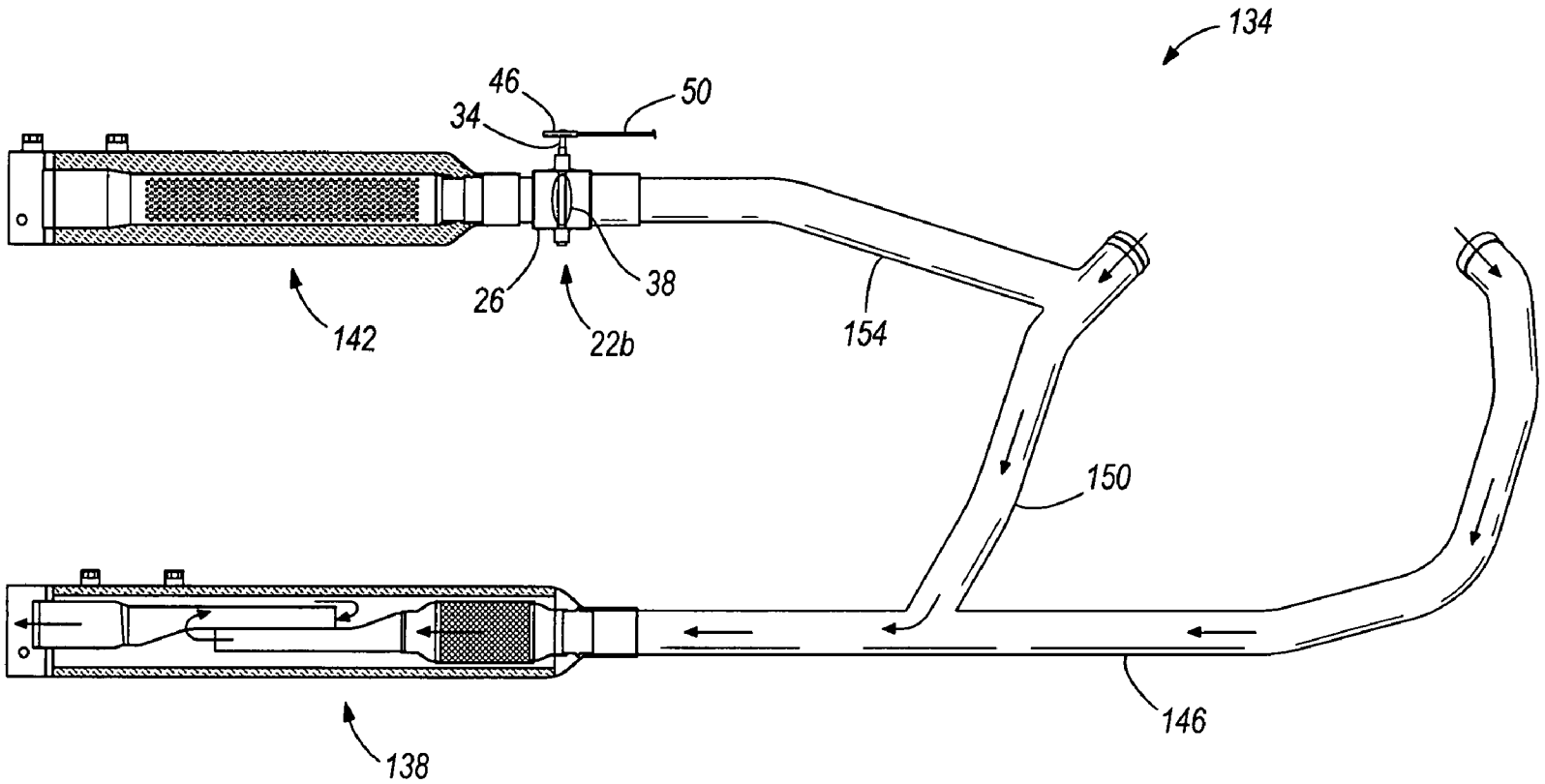
FIG. 4 is a partial cross-sectional view of the dynamic exhaust system of FIG. 3, illustrating exhaust gases flowing through a second flow path of the exhaust system.

FIGS. 3 and 4 illustrate a second construction of a motorcycle dynamic exhaust system 134 of the present invention. The exhaust system 134 is a dual exhaust system 134 including a first muffler 138 and a second muffler 142. In the illustrated construction, the first muffler 138 is a conventional multi-chamber muffler 138 while the second muffler 142 is a high-performance single chamber muffler 142. However, alternate constructions of the exhaust system 134 may utilize two high-performance single chamber mufflers 142 or two conventional multi-chamber mufflers 138.

In the illustrated construction, a valve **22*b* is positioned in the exhaust system 134 upstream of the second muffler 142. The valve 22*b* is substantially similar to the valve 22*a* shown in FIGS. 1 and 2. As shown in FIGS. 3 and 4, the exhaust system 134 also includes a first exhaust pipe 146 coupled to the first muffler 138, and a second exhaust pipe 150 coupled to and merged with the first exhaust pipe 146. The first and second exhaust pipes 146, 150 may be connected to respective exhaust ports of a motorcycle engine (e.g., a V-twin engine, not shown) to receive exhaust gases. The exhaust system 134 further includes a third exhaust pipe 154 coupled to and merged with the second exhaust pipe 150. The third exhaust pipe 154 is also coupled to the valve 22*b*, which, in turn, is coupled to the second muffler 142**.

With reference to FIG. 3, a first flow path of exhaust gases is shown through the exhaust system 134 by a sequence of arrows. The butterfly valve 38 is shown pivoted to an open position, in which unobstructed flow of exhaust gases is allowed through the valve **22*b*. More particularly, exhaust gases may be redirected from the second exhaust pipe 150 to the third exhaust pipe 154, thereby utilizing both of the first and second mufflers 138, 142**.

With reference to FIG. 4, a second flow path of exhaust gases is shown through the exhaust system 134 by a sequence of arrows. The butterfly valve 38 is shown pivoted to a closed position, in which exhaust gases are not allowed to flow through the valve **22*b*. More particularly, exhaust gases may not be redirected from the second exhaust pipe 150 to the second muffler 142, thereby only utilizing the first muffler 138 in the exhaust system 134**.

Figure 5:
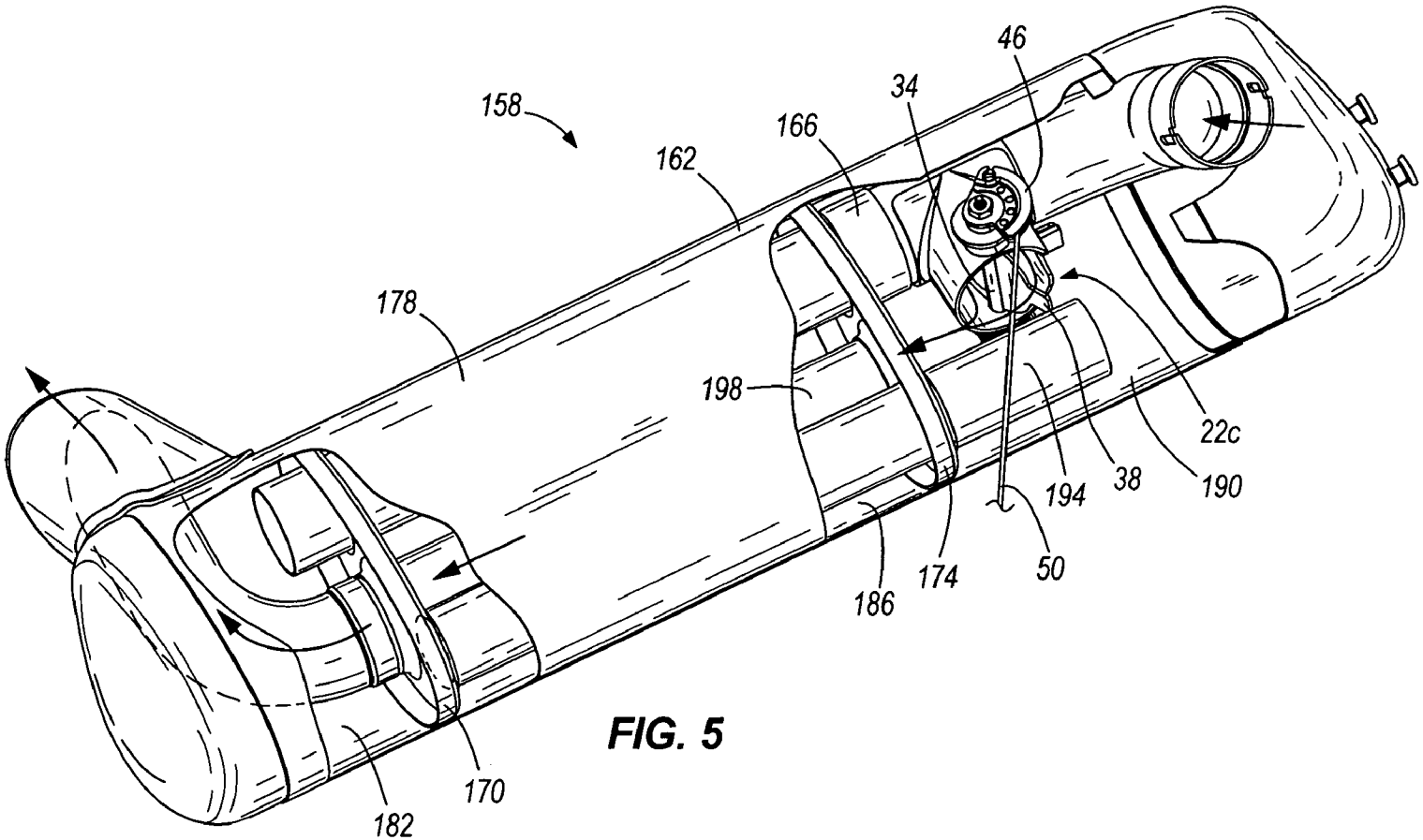
FIG. 5 is a cutaway perspective view of a third construction of a dynamic exhaust system embodying the present invention, illustrating exhaust gases flowing through a first flow path of the exhaust system.
Figure 6:
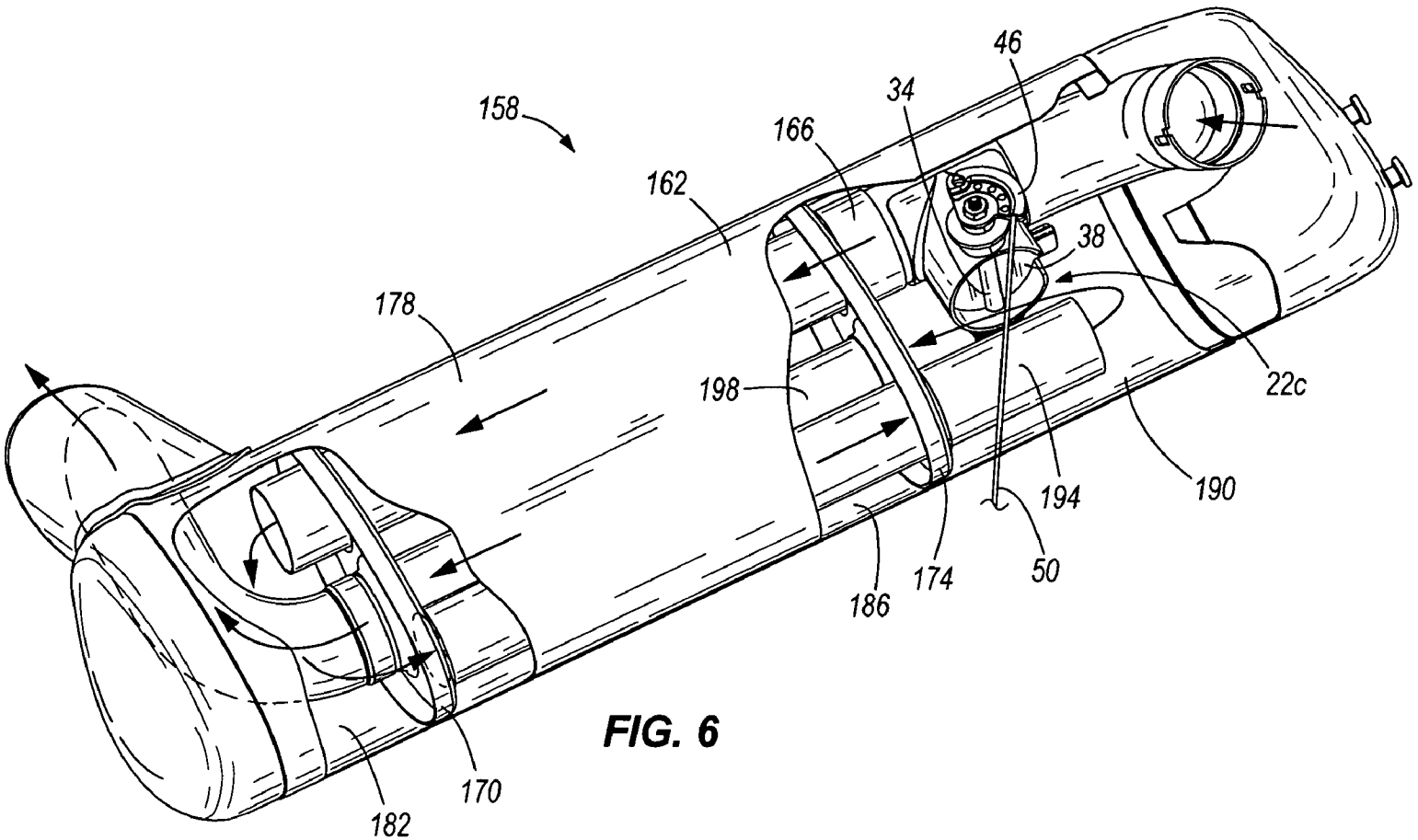
FIG. 6 is a cutaway perspective view of the dynamic exhaust system of FIG. 5, illustrating exhaust gases flowing through a second flow path of the exhaust system.

FIGS. 5 and 6 illustrate a third construction of a motorcycle dynamic exhaust system 158 of the present invention. The exhaust system 158 includes a muffler 162 coupled to an exhaust pipe (not shown) in a conventional manner. Although not shown, the motorcycle may include a dual exhaust system utilizing a second exhaust pipe and a second muffler.

Like the muffler 14 of FIGS. 1 and 2, the muffler 162 incorporates a valve **22*c* therein to direct the flow of exhaust gases through the muffler 162. The valve 22*c* is substantially similar to the valve 22*a* shown in FIGS. 1 and 2. As shown in FIGS. 5 and 6, the valve 22*c* is coupled to a first or inlet tube 166 of the muffler 162. The inlet tube 166 is supported by a first wall 170 and a second wall 174, which divide the interior space of the muffler 162 as bounded by an outer shell 178 into a first chamber 182, a second chamber 186, and a third chamber 190. The muffler 162 also includes a second or connecting tube 194 supported by the first and second walls 170, 174 that communicates the first and third chambers 182, 190. Further, the muffler 162 includes a third or outlet tube 198 supported by the first and second walls 170, 174 that communicates the third chamber 190** with the atmosphere.

With reference to FIG. 5, a first flow path of exhaust gases is shown through the exhaust system 158 by a sequence of arrows. The butterfly valve 38 is shown pivoted to an open position, in which unobstructed flow of exhaust gases is allowed through the valve 22*c*. As such, exhaust gases from the inlet tube 166 are allowed to discharge directly into the third chamber 190 (i.e., bypassing the first chamber 182), where the exhaust gases may flow through the outlet tube 198 and exit the muffler 162.

With reference to FIG. 6, a second flow path of exhaust gases is shown through the exhaust system 158 by a sequence of arrows. The butterfly valve 38 is shown pivoted to a closed position, in which exhaust gases are not allowed to flow through the valve 22*c*. As such, exhaust gases are directed to the first chamber 182 via the inlet tube 166, and to the third chamber 190 via the connecting tube 194. From the third chamber 190, the exhaust gases may flow through the outlet tube 198 and exit the muffler 162.

Figure 7:
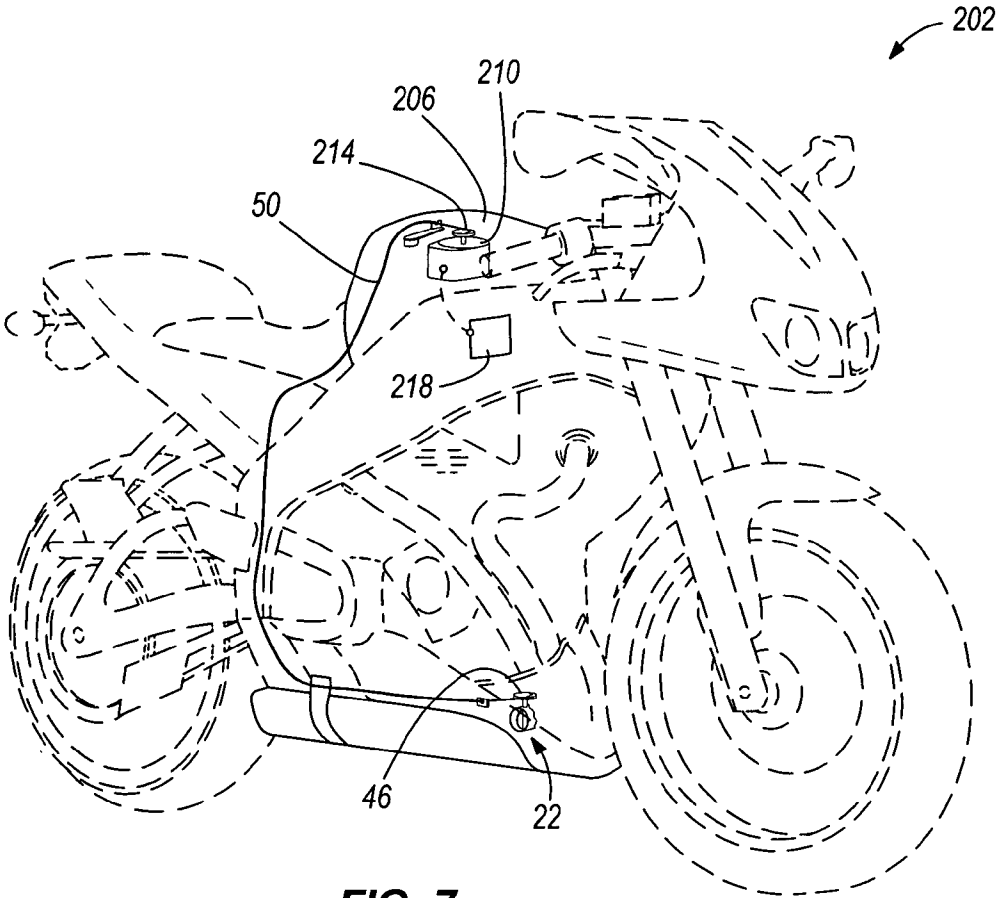
FIG. 7 is a perspective view of a motorcycle including the dynamic exhaust system of FIGS. 5 and 6, illustrating an actuator positioned remotely from the exhaust system.

With reference to FIG. 7, a motorcycle 202 is shown that incorporates the dynamic exhaust system 158 of FIGS. 5 and 6. FIG. 7 schematically illustrates the valve 22*c* positioned toward the bottom of the motorcycle 202. However, in a motorcycle configured to receive the exhaust systems 10, 134, the valves 22*a*, 22*b* may be positioned relative to the motorcycle in a location appropriate with the configuration of the respective exhaust systems 10, 134. As such, the position of the valve 22*c* as shown in FIG. 7 is for illustrative purposes only.

The illustrated motorcycle 202 is configured with an airbox (the location of which is designated by reference numeral 206) in a location on the motorcycle 202 typically associated with a fuel tank. The airbox 206 houses conventional air intake components (e.g., an air filter, not shown) for the engine. The airbox 206 is also configured to receive an actuator 210 for opening and closing the valve 22*c* of the exhaust system 158. The actuator 210 may be mounted on top of the airbox 206 and protected by a cover (not shown) covering the airbox 206.

The actuator 210 may be a conventional servo-motor having a quadrant or lever 214 for pulling or releasing the cable 50. The cable 50 is schematically illustrated as extending from the upper portion of the motorcycle 202 to the bottom portion of the motorcycle 202. However, the cable 50 may extend in any direction on the motorcycle 202 depending on the location of the valve 22*c* in the exhaust system 158. The cable 50 may also be substantially hidden from view by routing the cable 50 through frame members of the motorcycle 202 and/or hidden from view behind one or more fairings or body panels of the motorcycle 202.

The actuator 210 is electrically connected to an engine control unit 218 ("ECU") of the motorcycle 202. In addition to controlling other functions of the motorcycle 202 (e.g., fuel injection, engine timing, etc.), the ECU 218 is configured to control operation of the actuator 210. In addition, a second cable may be utilized to actuate a second valve.

Figure 8:
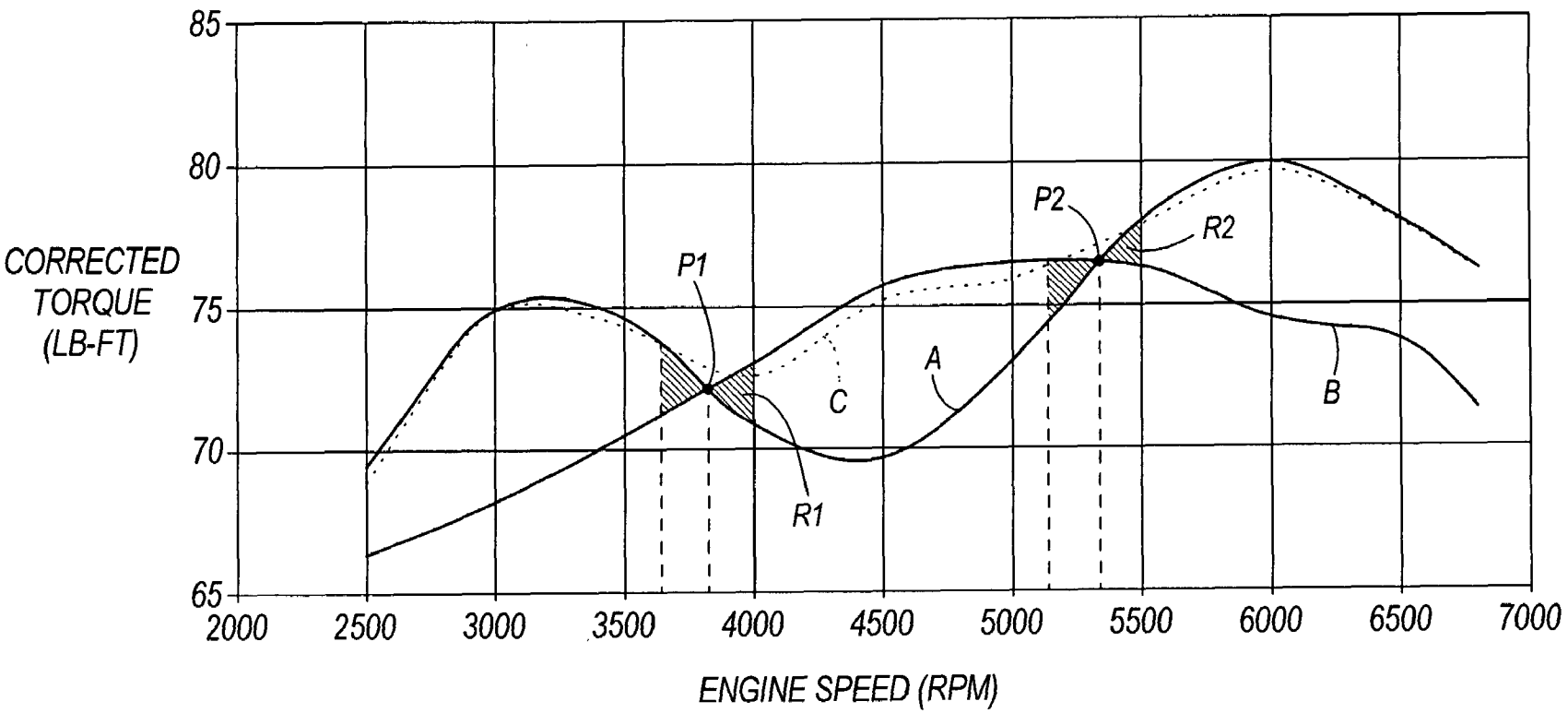
FIG. 8 is a graph illustrating a first torque characteristic of a motorcycle engine representative of exhaust gases flowing through the first flow path of the exhaust system of FIGS. 5 and 6, and a second torque characteristic of the motorcycle engine representative of exhaust gases flowing through the second flow path of the exhaust system of FIGS. 5 and 6.

Any of the dynamic exhaust systems 10, 134, 158 of FIGS. 1-6 may be utilized to alter the performance of the motorcycle's engine and/or alter the noise emission characteristics of the motorcycle's engine. With reference to FIG. 8, the engine's torque output is shown as a function of engine speed (measured in revolutions per minute, or RPM). More particularly, curve A illustrates the engine's torque output when the exhaust gases are routed through the first flow path of the exhaust system 158, in which the valve 22*c* is opened. Likewise, curve B illustrates the engine's torque output when the exhaust gases are routed through the second flow path of the exhaust system 158, in which the valve 22*c* is closed.

As shown in FIG. 8, the engine's torque output may be increased by opening the valve 22*c* during low engine speeds and during high engine speeds. However, maintaining the valve 22*c* open during mid-range engine speeds may also cause a decrease in torque output compared to the engine's output when the valve 22*c* is closed. Such a decrease in torque output may be caused by reversion of the exhaust gases in the exhaust system 158.

The engine exhibits different operating characteristics, or "torque characteristics," depending on the position (e.g., open or closed) of the valve 22*c*. For example, when the valve 22*c* is in an open position, the engine may exhibit a first torque characteristic defined by curve A. Likewise, when the valve is in a closed position, the engine may exhibit a second torque characteristic defined by curve B. Selective actuation of the valve 22*c* between open and closed positions may allow the engine to exhibit a third torque characteristic defined by curve C that takes advantage of the increase in torque output provided by the first operating characteristic during low engine speeds and high engine speeds, while also taking advantage of the torque output provided by the second operating characteristic during mid-range engine speeds to reduce the effects of the above-described reversion phenomena.

More particularly, for the engine to exhibit the third torque characteristic and follow curve C, the valve 22*c* is selectively controlled according to engine speed to cause the engine to switch or transition between exhibiting the first torque characteristic and exhibiting the second torque characteristic. For example, the valve 22*c* may be actuated from an open position to a closed position in a first crossover region, designated R1 in FIG. 8. The first crossover region R1 may be centered about a first intersection or crossover point (designated P1) of curve A and curve B. Crossover point P1 correlates with the engine speed at which the engine outputs substantially the same amount of torque whether it is exhibiting the first torque characteristic or the second torque characteristic. As shown in FIG. 8, crossover point P1 occurs at about 3800 RPM, and the crossover region R1 may extend between about 3600 RPM and about 4000 RPM. However, differently-configured engines may exhibit different torque characteristics than those defined by curve A and curve B. As such, crossover point P1 may occur at a higher or a lower engine speed than 3800 RPM, and the crossover region R1 may be wider (i.e., encompass a greater range of engine speeds) or more narrow (i.e., encompass a smaller range of engine speeds) than that illustrated in FIG. 8.

For the engine to continue exhibiting the third torque characteristic and following curve C, the valve 22*c* is actuated from the closed position back to the open position in a second crossover region, designated R2 in FIG. 8. The second crossover region R2 may be centered about a second intersection or crossover point (designated P2) of curve A and curve B. As shown in FIG. 8, crossover point P2 occurs at about 5300 RPM, and the crossover region R2 may extend between about 5100 RPM and about 5500 RPM. However, differently-configured engines may exhibit different torque characteristics than those defined by curve A and curve B. As such, crossover point P2 may occur at a higher or a lower engine speed than 5100 RPM, and the crossover region R2 may be wider (i.e., encompass a greater range of engine speeds) or more narrow (i.e., encompass a smaller range of engine speeds) than that illustrated in FIG. 8.

More particularly, the ECU 218 may be configured to trigger the actuator 210, which in turn may actuate the valve 22*c*, when the engine speed reaches the crossover points P1, P2 in the respective crossover regions R1, R2. However, with respect to the crossover region R1, the ECU 218 may trigger the actuator 210 at an engine speed within the crossover region R1 but at a lower speed or a higher speed than the crossover point P1. Likewise, with respect to the crossover region R2, the ECU 218 may trigger the actuator 210 at an engine speed within the crossover region R2 but at a lower speed or a higher speed than the crossover point P2.

The ECU 218 may also trigger the actuator 210 slightly before the engine speed reaches the crossover point P1, or slightly before the engine speed reaches the crossover point P2 to take into account the mechanical lag associated with the actuator 210, cable 50, and valve 22*c*. In addition, the ECU 218 may be configured to automatically make slight corrections to the engine speed when the valve 22*c* is actuated based upon input received by the ECU 218 from various engine or motorcycle sensors. Further, one or more conditions may need to be satisfied in order for the ECU 218 to trigger the actuator 210. For example, a condition that the engine must be operating at 75% of full throttle or more may need to be satisfied in order for the ECU 218 to trigger the actuator 210.

The ECU 218 may also be configured to trigger the actuator 210, and thus the valve 22*c*, according to the speed of the motorcycle 202. It may be desirable to trigger the actuator 210 according to the speed of the motorcycle 202 to alter the noise emission characteristics of the engine. For example, it may be desirable to operate the engine below a pre-determined sound level during mid-range cruising speeds (e.g., between 10 miles per hour and 50 miles per hour, or MPH). As a result, the ECU 218 may be configured to actuate the valve 22*c* from the open position to the closed position at about 10 MPH. In the closed position, the valve 22*c* directs exhaust gases along a second flow path longer than the first flow path to provide additional muffling of the sound pulses of the exhaust gases. At about 50 MPH, the ECU 218 may be configured to actuate the valve 22*c* back to the open position from the closed position. In the open position, the valve 22*c* directs exhaust gases along the first flow path to decrease the amount of muffling of the sound pulses of the exhaust gases. The ECU 218 may also be configured to trigger the actuator 210 at other motorcycle speeds depending on the desired sound levels or noise emission characteristics of the engine.

Various aspects of the invention are set forth in the following claims.

We claim:

1. A method of operating a dynamic exhaust system of a motorcycle engine, the method comprising:

providing a valve in the exhaust system that is movable to direct exhaust gases between a first flow path through the exhaust system and a second flow path through the exhaust system, the first flow path yielding a first torque characteristic of the engine and the second flow path yielding a second torque characteristic of the engine;

actuating the valve at a first speed to redirect exhaust gases from the first flow path to the second flow path and to operate the engine at its second torque characteristic; and actuating the valve at a second speed greater than the first speed to redirect exhaust gases from the second flow path to the first flow path and to operate the engine at its first torque characteristic, such that exhaust gases are directed through the first flow path at speeds both below the first speed and above the second speed.

2. The method of claim 1, wherein actuating the valve includes one of opening and closing the valve.

3. The method of claim 1, wherein actuating the valve occurs when the engine is operating at least about 75 percent of full throttle.

4. The method of claim 1, wherein actuating the valve to redirect exhaust gases from the first flow path to the second flow path occurs at a first engine speed, and wherein actuating the valve to redirect exhaust gases from the second flow path to the first flow path occurs at a second engine speed greater than the first engine speed.

5. The method of claim 1, wherein actuating the valve to redirect exhaust gases from the first flow path to the second flow path occurs at a first motorcycle speed, and wherein actuating the valve to redirect exhaust gases from the second flow path to the first flow path occurs at a second motorcycle speed greater than the first motorcycle speed.

6. The method of claim 1, wherein actuating the valve to redirect exhaust gases from the first flow path to the second flow path occurs at one of a first engine speed and a first motorcycle speed, and wherein actuating the valve to redirect exhaust gases from the second flow path to the first flow path occurs at one of a second engine speed greater than the first engine speed and a second motorcycle speed greater than the first motorcycle speed.

7. The method of claim 1, wherein actuating the valve to redirect exhaust gases from the first flow path to the second flow path occurs in a first crossover region of the first torque characteristic and the second torque characteristic, and wherein actuating the valve to redirect exhaust gases from the second flow path to the first flow path occurs in a second crossover region of the first torque characteristic and the second torque characteristic.

8. The method of claim 1, wherein the actuation of the valve at the first speed to redirect exhaust gases from the first flow path to the second flow path and to operate the engine at its second torque characteristic occurs as speed is increasing from a speed below the first speed, and wherein the actuation of the valve at the second speed to redirect exhaust gases from the second flow path to the first flow path and to operate the engine at its first torque characteristic occurs as speed further increases from a speed above the first speed.

9. The method of claim 1, further comprising triggering an actuator to actuate the valve.

10. The method of claim 9, wherein an engine control unit triggers the actuator.

* * * * *